US005218978A

United States Patent [19]

Yang et al.

[11] Patent Number: 5,218,978

[45] Date of Patent: Jun. 15, 1993

[54] COSMETIC CASE MIRROR ASSEMBLY POSITIONING DEVICE

[76] Inventors: Yi-Ming Yang, No. 356, Sec. 1 Chang Hsi St., Tainan; Han-Fong Huang, 5 Fl., No. 15-4, Sec. 5, Nanking E. Rd., Taipei, both of Taiwan

[21] Appl. No.: 950,892

[22] Filed: Sep. 25, 1992

[51] Int. Cl.[5] ..... A45D 42/02

[52] U.S. Cl. ..... 132/304; 132/296; 132/301; 132/316

[58] Field of Search ..... 132/291, 296, 301, 304, 132/316; 206/581, 823

[56] References Cited

U.S. PATENT DOCUMENTS

| | | | |
|---|---|---|---|
| 1,511,525 | 10/1924 | Saart | 132/296 |
| 1,541,451 | 6/1925 | Wallace | 132/296 |
| 1,583,120 | 5/1926 | Brenner | 132/296 |
| 1,732,866 | 10/1929 | Stiriss | 132/296 |
| 2,054,650 | 9/1936 | Bienstock | 132/316 |
| 2,461,421 | 2/1949 | Jacobus | 132/316 |
| 2,635,612 | 4/1953 | Dean | 132/316 |
| 5,107,871 | 4/1992 | Butcher et al. | 132/304 |

FOREIGN PATENT DOCUMENTS

| | | | |
|---|---|---|---|
| 753647 | 7/1956 | United Kingdom | 132/301 |

*Primary Examiner*—Gene Mancene
*Assistant Examiner*—Frank A. LaViola
*Attorney, Agent, or Firm*—Varndell Legal Group

[57] ABSTRACT

A cosmetic case mirror assembly positioning device includes a mirror frame holder having two spaced lugs raised from one side of an elongate base plate fastened to the top cover of a cosmetic case on the inside, and a mirror frame having two lugs respectively pivoted to either lug on the mirror frame holder and two toothed supports respectively and releasably meshed with the toothed top edge of either lug on the mirror frame holder, and a mirror inserted into a channel on the mirror frame and locked in place by latch pins.

4 Claims, 7 Drawing Sheets

COSMETIC CASE MIRROR ASSEMBLY POSITIONING DEVICE

BACKGROUND OF THE INVENTION

The present invention relates to a cosmetic case mirror assembly positioning device which secures a mirror to the top cover of a cosmetic on the inside for permitting the mirror to be adjusted to any of a series of angular positions.

A cosmetic case generally has a mirror on the inside of the top cover thereof in which one can see oneself while applying cosmetics. The mirror, as illustrated in FIG. 8, is comprised of a mirror glass retained in a mirror frame by a back board and a plurality of lock pins, which mirror frame is directly fastened to the top cover of the cosmetic case on the inside. One disadvantage of this mirror positioning structure is that the mirror frame can only be adjusted downwardly, and therefore the angular position of the mirror is limited to a narrow range. Another disadvantage of this mirror positioning structure is that the mounting procedure of the mirror glass is complicated. Still another disadvantage of this mirror positioning structure is its complicated manufacturing procedure.

SUMMARY OF THE INVENTION

The present invention eliminates the aforesaid disadvantages. It is therefore an object of the present invention to provide a cosmetic case mirror assembly positioning device which pivots a mirror frame to a mirror frame holder fastened inside the top cover of a cosmetic case for permitting a mirror to be adjusted to any of a wide range of angles. It is another object of the present invention to provide a cosmetic case mirror assembly positioning device which comprises two toothed supports raised from the back surface of the mirror frame thereof respectively meshed with teeth on the lugs of the mirror frame holder for retaining the mirror frame in the desired angular position. It is still another object of the present invention to provide a cosmetic case mirror assembly positioning device which comprises a mirror channel on the back side of the mirror frame thereof for mounting the mirror easily. It is still another object of the present invention to provide a cosmetic case mirror assembly positioning device which has pin holes on the back side of the mirror frame thereof for inserting headed latch pins in locking the mirror in position.

DETAILED DESCRIPTION OF THE PREFERRED EMBODIMENT

Figure 1:
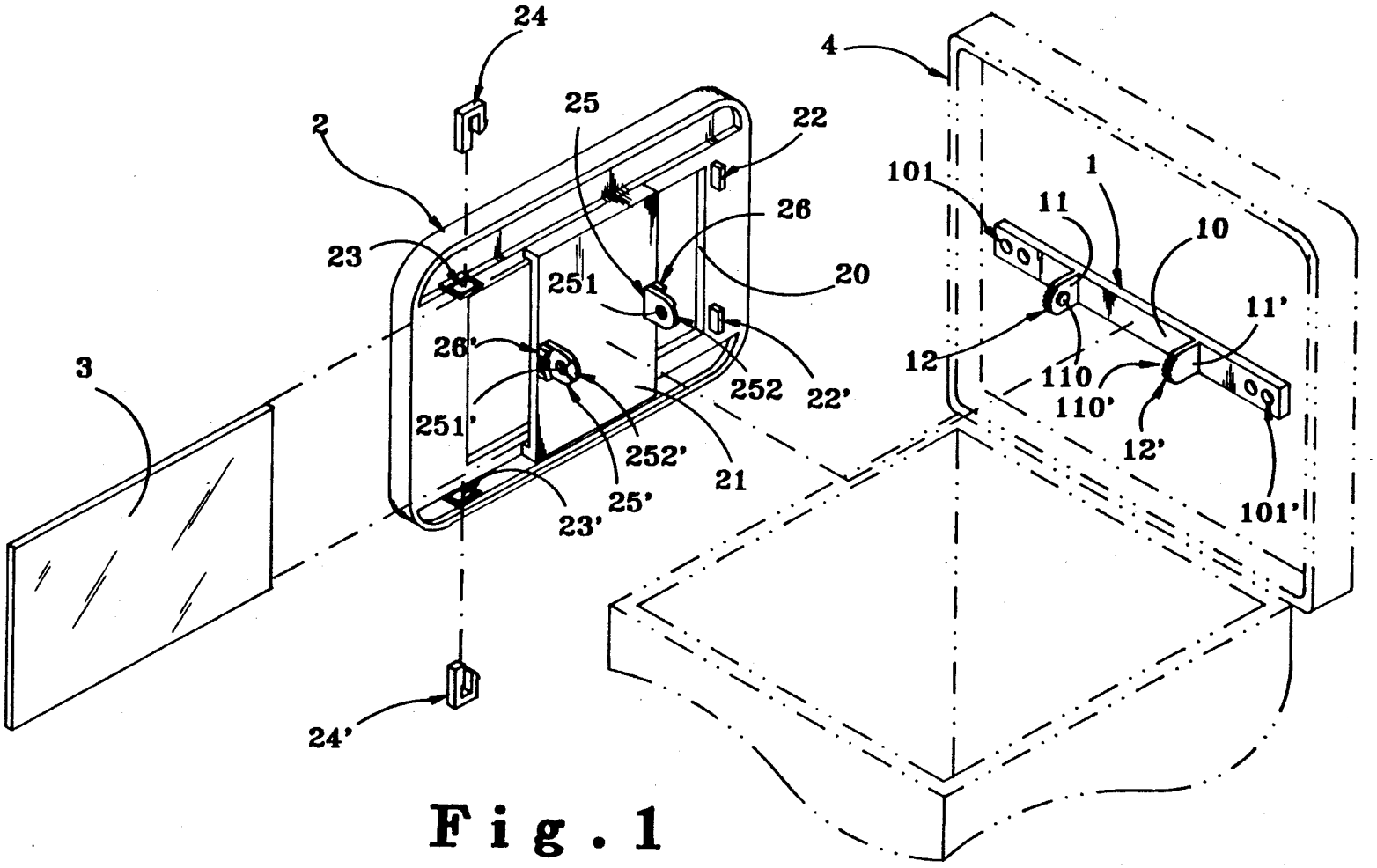
FIG. 1 is an exploded view of the preferred embodiment of the cosmetic case mirror assembly positioning device of the present invention.
Figure 2:
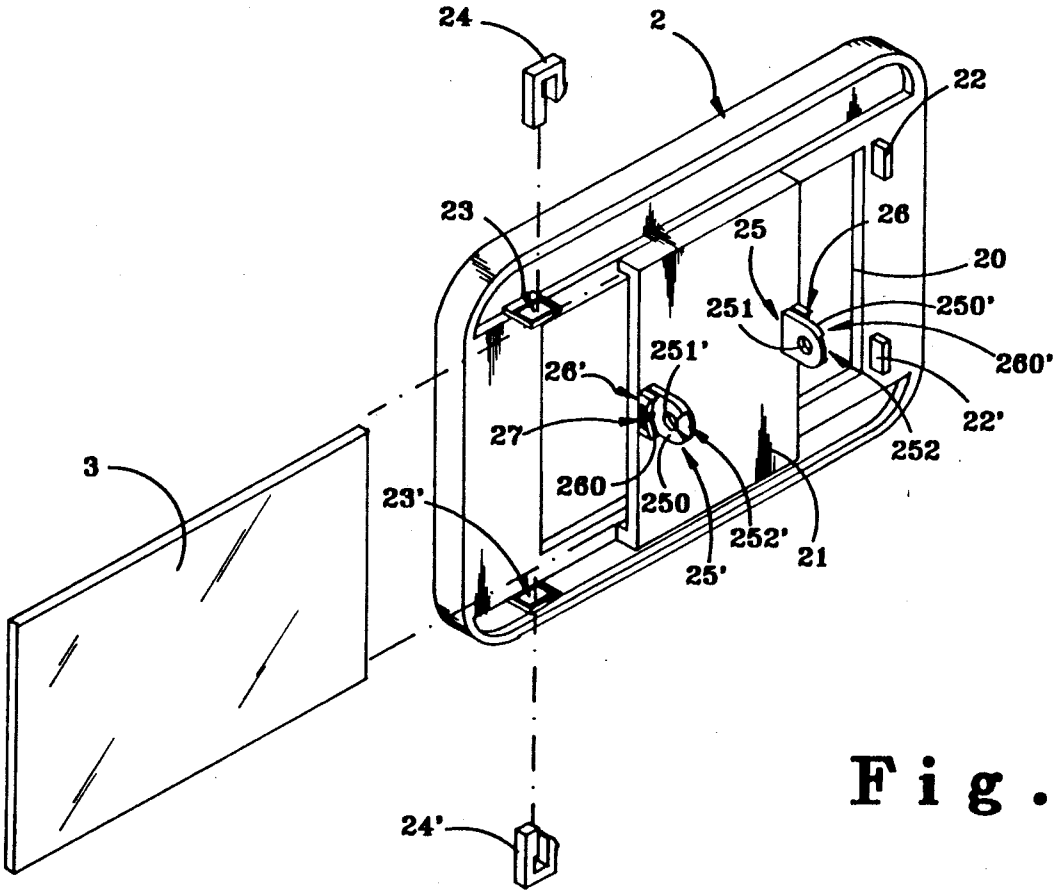
FIG. 2 is an exploded view of a mirror assembly according to the present invention.
Figure 3:
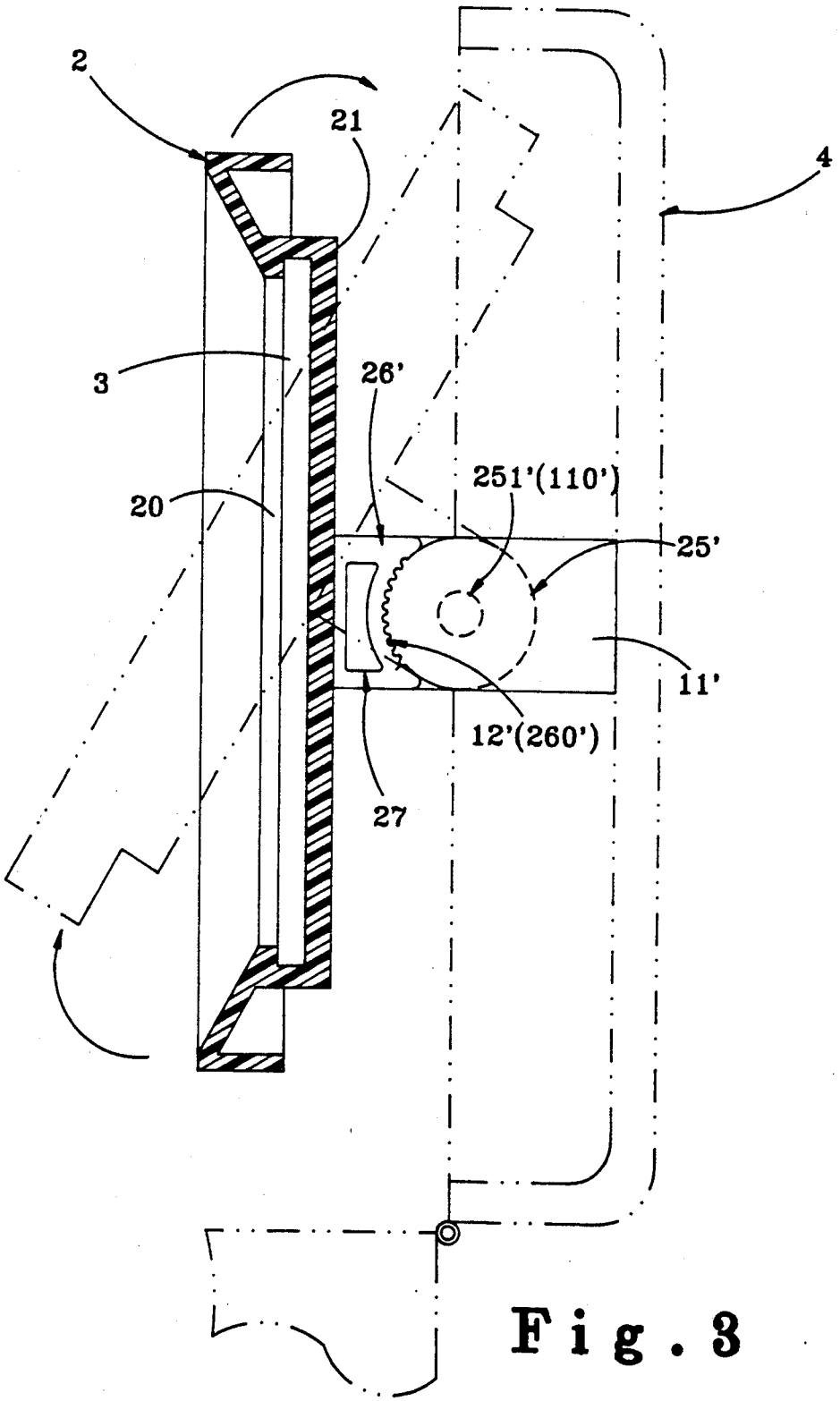
FIG. 3 is a sectional side view showing the relative positioning of the mirror assembly on a mirror frame holder inside the top cover of a cosmetic case.
Figure 4:
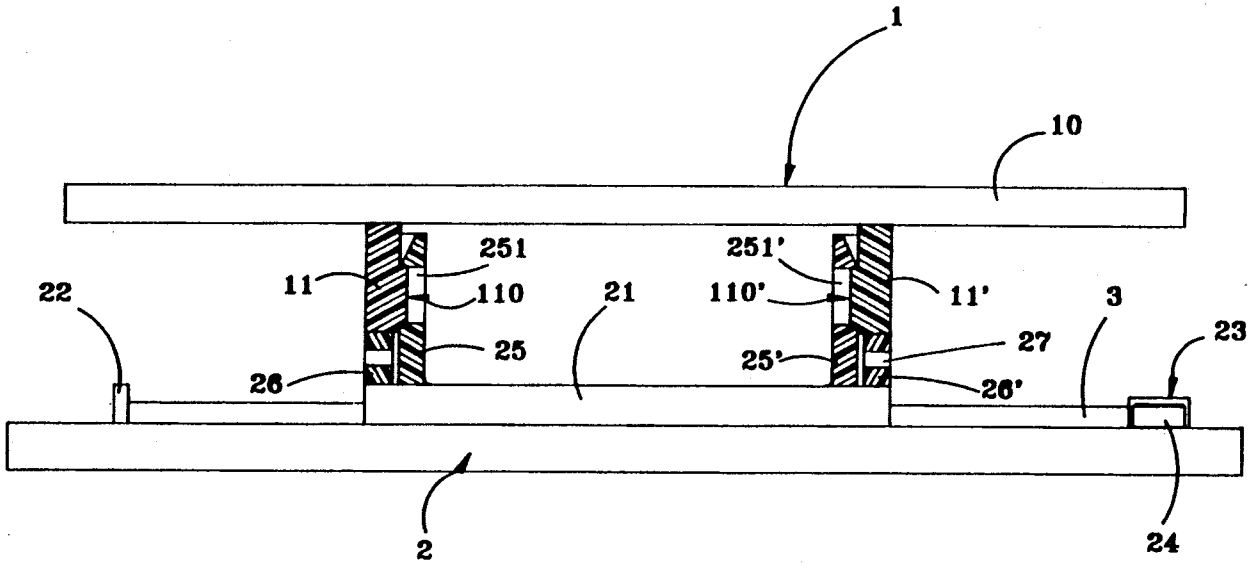
FIG. 4 is another sectional side view showing the lugs on the mirror frame holder respectively pivoted to the lugs on the mirror assembly and meshed with toothed supports on the mirror frame assembly.
Figure 5:
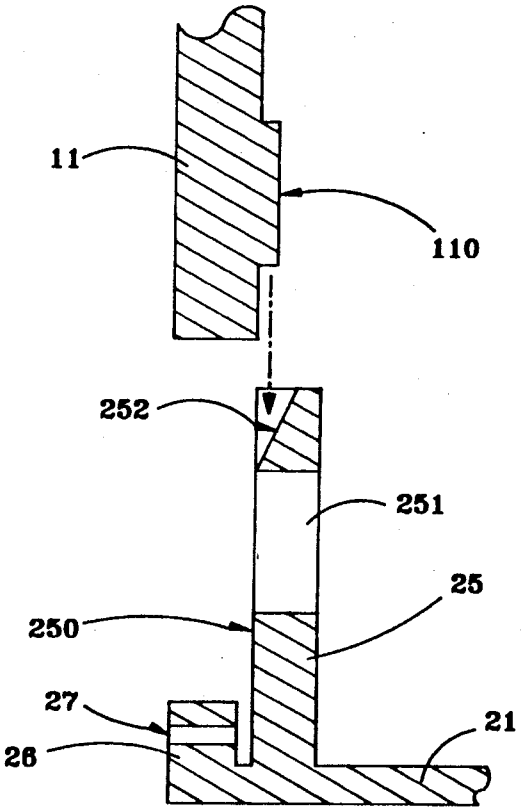
FIG. 5 is an enlarged sectional view of a lug of the mirror frame holder and a corresponding lug and a corresponding toothed support of the mirror assembly before the assembly process.
Figure 6:
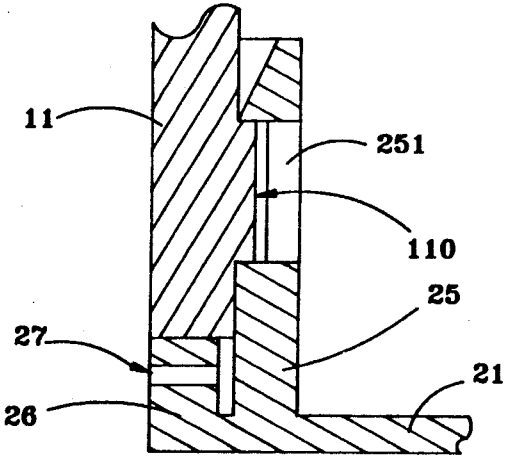
FIG. 6 is an assembly view of FIG. 5.
Figure 7:
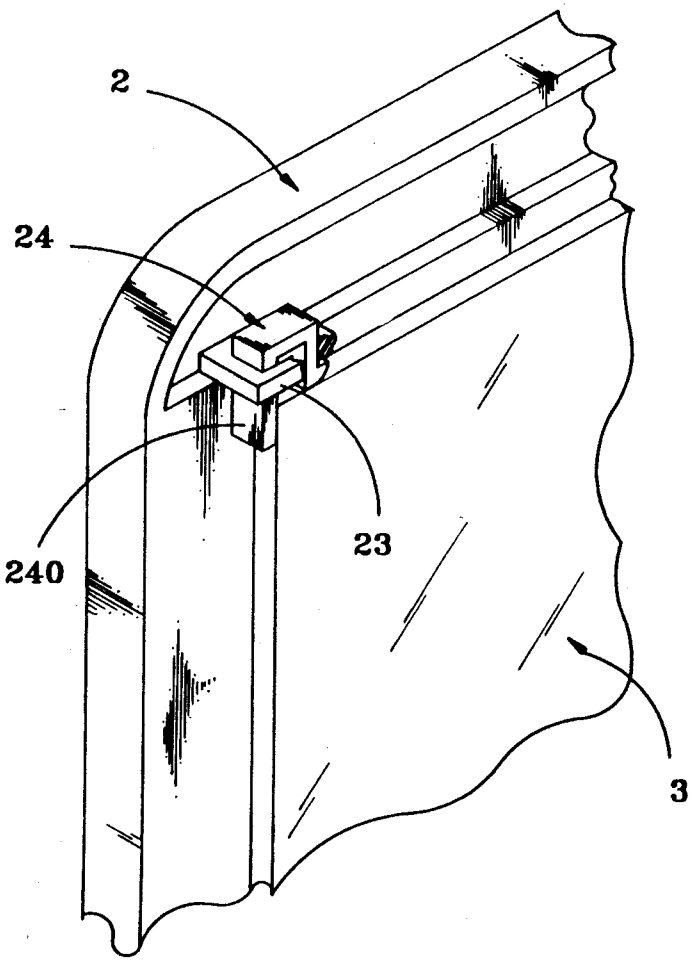
FIG. 7 is a partly enlarged view showing a latch pin inserted in a respective pin hole on the mirror frame of the mirror assembly to lock a mirror in position.
Figure 8:
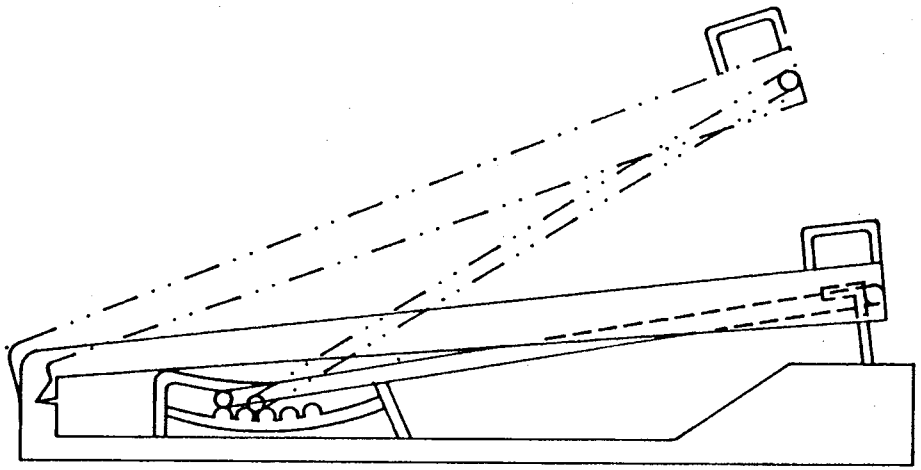
Fig.8 PRIOR ART
FIG. 8 is a sectional view showing a cosmetic case mirror assembly positioning structure according to the prior art.

Referring to FIGS. 1 and 2, the present invention comprises a mirror frame holder 1 fastened to the top cover 4 of a cosmetic case on the inside, and a mirror assembly consisted of a mirror frame 2 and a mirror 3 and secured to the mirror frame holder 1. The mirror frame holder 1 and the mirror frame 2 are respectively made from polymerization polymers through the process of injection molding. The mirror frame holder 1 comprises an elongate base plate 10 having symmetrical through holes 101,101' on two opposite ends thereof and two lugs 11,11' raised from one side thereof at two opposite ends. Screws (not shown) are respectively threaded through the holes 101,101' into screw holes (not shown) on the top cover 4 of the cosmetic case to fasten the mirror frame holder 1 to the top cover 4 of the cosmetic case on the inside. Each lug 11 or 11' has an arched, toothed top edge 12 or 12' and a stub rod 110 or 110' on an inner side perpendicular to the respective toothed top edge 12 or 12' and opposed to each other. The mirror frame 2 comprises a flat, rectangular opening 20 in a longitudinal direction, which is covered by the mirror 3, a bridge wall 21 bridged over the opening 20 on the back side in a transverse direction for permitting the mirror 3 to be inserted into the gap between the back surface of the mirror frame 2 and the bridge wall 21 and retained in a position covered over the opening 20. Therefore, the mirror 3 can be slided in and out of the mirror frame 2. The mirror frame 2 further comprises stop plates 22,22' spaced on the back surface thereof at one end adjacent to the opening 20 to stop the mirror 3 in position, two pin holes 23,23' spaced on the back surface thereof at an opposite end, into which a headed latch pin 24 or 24' each may be respectively inserted to lock the mirror 3 in place. As illustrated in FIG. 7, each headed latch pin 24 or 24' has an elongate leg 240 inserted through either pin hole 23 or 23' to stop the mirror 3 from moving backwards. The latch pin 24 or 24' is made from polymerization polymers, and can be conveniently removed from the respective pin hole 23 or 23' permitting the mirror 3 to be removed from the mirror frame 2. The bridge wall 21 of the mirror frame 2 comprises two symmetrical lugs 25,25' on two opposite sides respectively attached to either lug 11 or 11' on the base plate 10 of the mirror frame holder 1 at an inner side, and two toothed supports 26,26' respectively disposed adjacent to either lug 25 or 25' at an outer side. As illustrated in FIGS. 5 and 6, each lug 25 or 25' has a pivot hole 251 or 251, which receives the stub rod 110 or 110' on either lug 11 or 11' of the base plate 10 of the mirror frame holder 1, and a sloping groove 252 or 252' one one side 250 or 250' thereof extended from the top edge to the respective pivot hole 251 or 251' for guiding the stub rod 110 or 110' on the respective lug 11 or 11' of the mirror holder 1 into the respective pivot hole 251 or 251'. As illustrated in FIG. 3, each toothed support 26 or 26' has a toothed top edge 260 or 260' curved inwards, and a slot 27 or 27' through the body thereof. The arrangement of the slot 27 or 27' permits the toothed support 26 or 26' to be squeezed to deform. Once the pressure is released, the elastic material property makes the toothed support 26 or 26' to automatically return to its original shape.

Referring to FIGS. 3, 4, 5 and 6, the lugs 25,25' on the bridge wall 21 of the mirror frame 2 are respectively attached to the lugs 11,11' on the base plate 10 of the mirror frame holder 1 with the stub rods 110,110 respectively inserted into the pivot holes 251,251', therefore the mirror frame 2 is pivoted to the mirror frame holder 1. As the mirror frame 2 and the mirror frame holder 1 have been pivoted to each other, the toothed top edge 12 or 12' on each lug 11 or 11' of the mirror frame holder 1 respectively meshed with the toothed top edge 260 or 260' on the toothed support 26 or 26' of the mirror frame 2. As described before, the toothed supports 26,26' can be squeezed to deform, therefore the mirror frame 2 can be rotated on the lugs 11,11' of the mirror frame holder 1 to change the angular position.

The preferred embodiment described is simple in structure and therefore functional. However, it is to be understood that various changes and modifications may be made without departing from the scope of the invention and the invention is not considered limited to what is shown in the drawings and described in the specification.

We claim:

1. A cosmetic case mirror assembly positioning device comprising:

a mirror frame holder having two spaced lugs raised from one side of an elongate base plate fastened to a top cover of a cosmetic case on the inside, each lug having an arched, toothed top edge and a stub rod on an inner side perpendicular to the respective toothed top edge and opposed to each other; and a mirror frame pivoted to the lugs on said mirror frame holder to hold a mirror, said mirror frame comprising a flat, rectangular window opening in a longitudinal direction covered by said mirror, a bridge wall bridged over said window opening and defining with said mirror frame a mirror channel into which said mirror is slided in and out, two stop plates spaced on a back surface thereof at one end adjacent to said window opening to stop said mirror at one end, two pin holes spaced on said back surface at an opposite end, two headed latch pins respectively and releasably inserted in either pin hole to stop said mirror at an opposite end for permitting said mirror to be retained in a position covered over said window opening, said bridge wall comprising two symmetrical lugs on two opposite sides respectively to either lug on said base plate of said mirror frame holder at an inner side, and two toothed supports at locations corresponding to the lugs on said base plate of said mirror frame holder, each lug of said bridge wall having a pivot hole, which receives the stub rod on either lug of said base plate of said mirror frame holder, each toothed support of said bridge wall having a toothed top edge curved inwards and meshed with the toothed top edge of the respective lug on said base plate of said mirror frame holder, and a slot through a body thereof for permitting it to be squeezed to deform.

2. The cosmetic case mirror assembly positioning device of claim 1 wherein said mirror frame, said mirror frame holder and said latch pins are respectively made from polymerization polymers.

3. The cosmetic case mirror assembly positioning device of claim 1 wherein said bridge wall has two opposite ends extended from a back wall of said mirror frame and respectively spaced from said window opening, and defines with said mirror frame a mirror channel in with wider than said window opening for sliding said mirror.

4. The cosmetic case mirror assembly positioning device of claim 1 wherein said toothed supports each has a sloping groove on one side thereof extended from a top edge thereof to the respective pivot hole for guiding the respective stub rod on said base plate of said mirror frame holder into the respective pivot hole.

* * * * *